US005544365A

United States Patent [19]

Mondy

[11] Patent Number: 5,544,365

[45] Date of Patent: Aug. 13, 1996

[54] CLOTHING ARTICLE HAVING AN EXTENSIBLE DISPLAY

[76] Inventor: Kertious Mondy, 3420 Elizabeth St., Apt. 11, Miami, Fla. 33133

[21] Appl. No.: 258,208

[22] Filed: Jun. 10, 1994

[51] Int. Cl.[6] ..... A41B 1/00

[52] U.S. Cl. ..... 2/115; 2/69

[58] Field of Search ..... 2/115, 108, 102, 2/106, 69, 2, 1; 441/90, 102

[56] References Cited

U.S. PATENT DOCUMENTS

| | | | |
|---|---|---|---|
| 2,005,460 | 6/1935 | Fried | 441/102 |
| 2,527,258 | 10/1950 | Kahn . | |
| 2,589,409 | 3/1952 | Leichter . | |
| 2,647,261 | 8/1953 | Rassner . | |
| 2,685,690 | 8/1954 | Chrisman . | |
| 3,193,842 | 7/1965 | Bell . | |
| 3,484,974 | 12/1969 | Culmone . | |
| 4,274,159 | 6/1981 | Schmidt | 2/2 |
| 4,404,689 | 9/1983 | DeWan . | |
| 4,969,214 | 11/1990 | Cohen . | |
| 5,048,123 | 9/1991 | Monson | 2/108 |
| 5,079,778 | 1/1992 | Sloot | 2/69 |
| 5,173,968 | 12/1992 | Fox . | |

*Primary Examiner*—C. D. Crowder
*Assistant Examiner*—Gloria Hale
*Attorney, Agent, or Firm*—Laubscher & Laubscher

[57] ABSTRACT

A novelty clothing article is characterized by a flexible three-dimensional display member which extends from a pocket in the article. The display member is folded within the pocket which is closed by a zipper. As the zipper is opened, the display member automatically extends from the pocket and assumes a predetermined configuration such as a body part, animal or the like. The display member is formed of a flexible, resilient material which is capable, when released, of re-assuming the predetermined configuration to provide a three-dimensional display on the clothing article.

5 Claims, 2 Drawing Sheets

CLOTHING ARTICLE HAVING AN EXTENSIBLE DISPLAY

BACKGROUND OF THE INVENTION

Many articles of clothing serve more purposes than covering and warming the body. In addition to making fashion statements, individuals also use clothing to make political statements, to show their allegiance, and as forms of amusement. Sweatshirts, tee shirts, baseball caps and the like are commonly emblazoned with logos from professional sports teams, colleges, and universities. Artistic designs and slogans are printed on shirts to arouse and stimulate thoughts and responses. Clothing can thus be used as a means of exhibiting freedom of speech to the same or even a greater degree than the spoken word.

Most expressions of opinion or allegiance used on clothing are limited to two dimensions, primarily through printing on an article of clothing. The present invention relates to a new clothing article which incorporates a three-dimensional display.

BRIEF DESCRIPTION OF THE PRIOR ART

Garments incorporating display elements are well-known in the patented prior art. For example, kahz U.S. Pat. No. 2,527,258, Rassner U.S. Pat. No. 2,647,261, Chrisman U.S. Pat. No. 2,685,690, and Culmone U.S. Pat. No. 3,484,974 disclose shirts or jackets with removable displays such as advertisements, nameplates and the like. All of the displays are two dimensional.

The Cohen U.S. Pat. No. 4,969,214 discloses a jacket for displaying information wherein the jacket includes pockets for receiving informational display panels. The panels can be suspended from the jacket when used in a display mode, and can be stored in the pocket when they are to be hidden from view. As with the aforementioned patents, the displays of the Cohen device are two-dimensional.

It is also known in the art to provide flexible containers for clothing articles as shown by the DeWan U.S. Pat. No. 4,404,689. The container has a self-sustaining three-dimensional shape within which the garment may be folded for transport. When the garment is to be worn, it is withdrawn from the container, but has edges connected with edges of the container whereby the container remains attached to the garment when the garment is worn.

While the prior devices operate satisfactorily, they are limited in their impact on the public since the displays are rather common two-dimensional representations. That is, the visual impression is restricted by the two-dimensional displays.

The present invention was developed in order to provide a more striking three-dimensional display for an article of clothing which is operable between a retracted concealed position within the clothing article and an extended display condition.

SUMMARY OF THE INVENTION

Accordingly, it is a primary object of the present invention to provide a clothing article such as a shirt, sweatshirt, or jacket which includes a main body section containing a pocket, a closure for opening and closing the pocket, and a resilient, compressible display member connected with the clothing article body section within the pocket. The display member has a predetermined configuration when it is in an extended position, yet is compressible or foldable to fit within the pocket which is closed by the closure. As the closure opens the pocket, the display automatically pops out of the pocket and assumes its predetermined configuration extending from the pocket.

The display member is formed from a layer of synthetic rubber or latex material which is connected at its periphery with the pocket. When compressed for insertion in the pocket, the display member can be folded back upon itself. When extended into its predetermined configuration, the display member is hollow.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
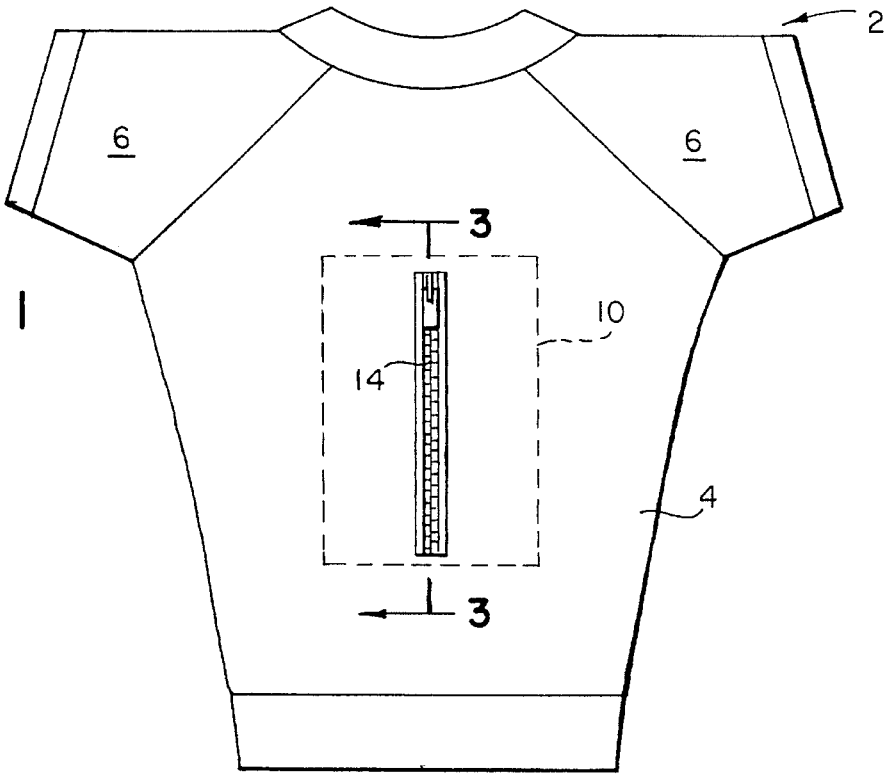
FIG. 1 is a front plan view of the clothing article of the present invention in its closed position with the display member concealed within a pocket.

In FIG. 1, there is shown a clothing article 2 such as a tee shirt including a main body section 4 and arm sections 6. While the invention will be described in connection with the tee shirt shown in the drawing, it is apparent to those of ordinary skill in the art that any clothing article such as a sweatshirt, a jacket, a pair of pants or the like may be used. What is important is that the garment be formed of flexible fabric.

The front portion of the main body section is slit open 8 and has a piece of fabric 10 (FIGS. 3 and 4) connected thereto behind the opening to define a recessed pouch or pocket 12. Access to the pocket is afforded via the opening. A closure, such as a zipper 14, is connected with the main body section on opposite sides of the opening for opening and closing the same. Other conventional closures such as hook and pile fasteners, snaps, or buttons may be substituted for the zipper. Furthermore, while the opening has been illustrated on the front of the tee shirt, it could readily be provided on the rear, side, or arm portions thereof without materially altering the invention. In fact, more than one opening/pocket can be provided if desired.

Figure 3:
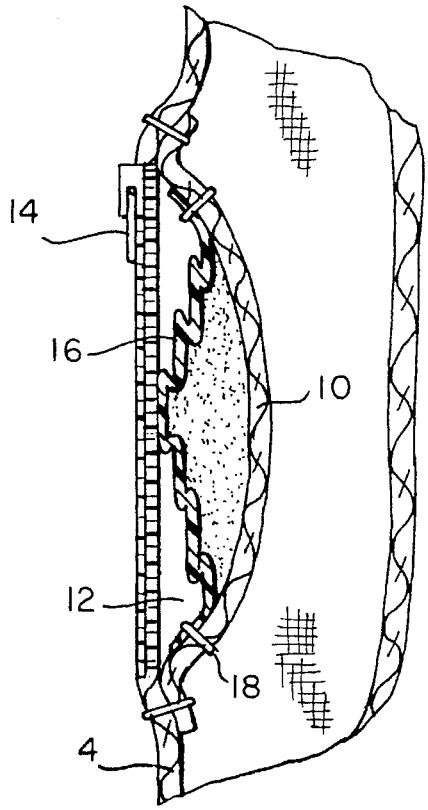
FIG. 3 is a sectional view taken along line 3—3 of FIG. 1 showing the display and pocket in the closed position.
Figure 4:
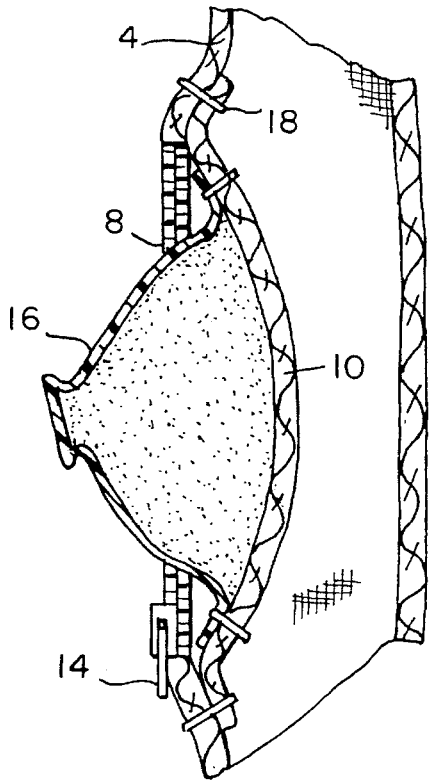
FIG. 4 is a section view taken along line 4—4 of FIG. 2 showing the display and pocket in the extended open position.

A display member 16 is connected with the fabric 10 as shown in FIGS. 3 and 4. The display member is formed of a layer of synthetic rubber or latex material, or any flexible, resilient material which can be extended into a predetermined configuration. Preferably, the display member is connected about its periphery with the layer of fabric within the pocket by any suitable means such as stitches 18.

Figure 2:
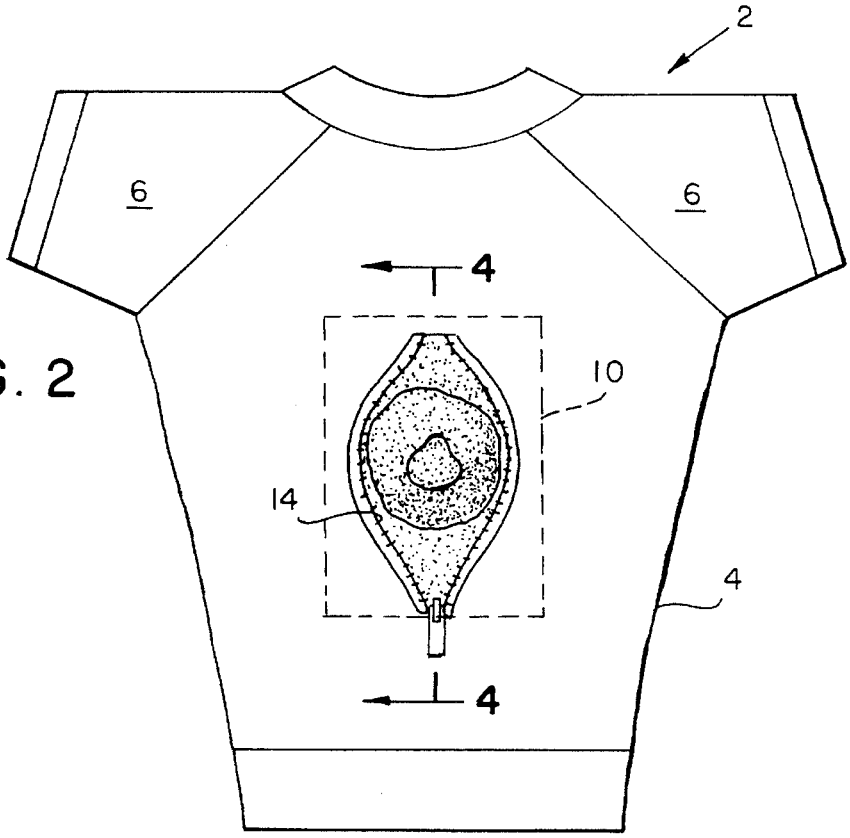
FIG. 2 is a front plan view of the clothing article of the invention in its open position with the display member extended and projecting from the pocket.

In operation, the display member 16 is compressed or folded into the pocket 12 as shown in FIG. 3 and the zipper 14 is closed to retain the display member in a concealed position within the pocket as shown in Fig. 1. When the zipper is pulled downwardly to open the opening, the resilient display member automatically pops out of the pocket to assume its predetermined extended configuration shown in FIGS. 2 and 4. The extended configuration is the normal configuration of the display member. When extended, the member defines a hollow, three-dimensional display.

The display member can be provided with a number of different configurations including for example, body parts, animal heads or snouts, geometric shapes and the like. Thus, the garment can serve as a novelty item with a wide variety of display members provided in the pocket.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A clothing article, comprising (a) a main body section containing a recessed pocket;

(b) closure means connected with said body section for opening and closing said pocket; and (c) a resilient compressible display member having a predetermined extended configuration, said display member having a peripheral portion connected with said body section within said pocket, said display member being compressed from said extended configuration for insertion within said pocket when said closure means closes said pocket, said display member automatically extending into the predetermined configuration beyond said pocket when said closure means opens said pocket with said peripheral portion remaining within said pocket.

2. A clothing article as defined in claim 1, wherein said display member is formed of a layer of material having a peripheral edge connected with said body section, whereby said display member is hollow when it is extended into its predetermined configuration.

3. A clothing article as defined in claim 2, wherein said display member is formed from a synthetic material.

4. A clothing article as defined in claim 3, wherein said main body section is formed of flexible material.

5. A clothing article as defined in claim 4, wherein said closure means comprises a zipper.

* * * * *